US005314001A

United States Patent [19]

Hidaka et al.

[11] Patent Number: 5,314,001

[45] Date of Patent: May 24, 1994

[54] METHOD OF CASTING VEHICLE WHEEL

[75] Inventors: Akio Hidaka; Tsutomu Terajima; Yuu Haga; Shigemitsu Nakabayashi; Akihiro Okumura, all of Sayama, Japan

[73] Assignee: Honda Giken Kabushiki Kaisha, Tokyo, Japan

[21] Appl. No.: 68,261

[22] Filed: May 28, 1993

Related U.S. Application Data

[63] Continuation of Ser. No. 821,370, Jan. 16, 1992, abandoned.

[30] Foreign Application Priority Data

Feb. 27, 1991 [JP] Japan ..... 3-033122
Feb. 28, 1991 [JP] Japan ..... 3-034308

[51] Int. Cl.[5] ..... B22D 18/04; B22D 27/04
[52] U.S. Cl. ..... 164/125; 164/119
[58] Field of Search ..... 164/122.1, 125–128, 164/119, 306, 348

[56] References Cited

FOREIGN PATENT DOCUMENTS 63-6157 1/1988 Japan .
63-278636 11/1988 Japan ..... 164/348
2-41762 2/1990 Japan ..... 164/348
2-151344 6/1990 Japan .
2196281 4/1988 United Kingdom ..... 164/122.1
2208817 4/1989 United Kingdom .

*Primary Examiner*—Kuang Y. Lin
*Attorney, Agent, or Firm*—Armstrong, Westerman, Hattori, McLeland & Naughton

[57] ABSTRACT

The lower mold which forms the external side of the vehicle wheel is water-cooled by water-cooling pipes. The rib-forming portions of the upper mold which forms the internal side of the vehicle wheel are forcibly air-cooled by the air passages provided along the rib-forming portions. Since water-cooling has better cooling capacity than air-cooling, the molten material inside the cavity between the lower mold and the upper mold is solidified from the external side thereof, and no defects such as shrinkage cavities occur on the external side thereof. When the internal side is solidified, the rib portions are solidified not much later than the other portion of the internal side, thereby shortening the casting cycle time. The split molds which form the cavity for forming therein the rim portion of the vehicle wheel are opened earlier than the upper mold, at the time when the surface layer portion of the molten material in the cavity has been solidified. If the split molds are kept clamped, the clearance to be generated between the split molds and the molten material upon contraction thereof due to solidification, restricts the heat dissipation from the molten material to the split molds, resulting in retarded solidification. To the contrary, early opening of the split molds leads to accelerated solidification of the molten material due to cooling of the rim portion by the atmosphere.

5 Claims, 3 Drawing Sheets

METHOD OF CASTING VEHICLE WHEEL

This application is a continuation of application Ser. No. 07/821,370 filed Jan. 16, 1992, now abandoned.

BACKGROUND OF THE INVENTION

This invention relates to a method of casting vehicle wheels such as aluminum wheels or the like.

As is disclosed in the Japanese Published Unexamined Patent Application No. 151344/Heisei 2 (1990), there is conventionally known a method of casting a vehicle wheel by using mold means which comprises a lower mold and an upper mold which together form a cavity for molding therein a disk portion of the vehicle wheel, and split molds which form a cavity for molding therein a rim portion of the vehicle wheel by enclosing the lower and the upper molds. In this method, the split molds are opened when a molten material in the cavities has been completely solidified and the lower and the upper molds are also opened to take out a product.

In this method, the external side of the vehicle wheel which faces an outside of a vehicle when mounted thereon is molded by the lower mold. Cooling water passages are provided in the lower mold and the lower mold is water-cooled by means of cooling water which flows through the passages. The solidification of the external side of the vehicle wheel is thus accelerated so that no defects, such as, shrinkage cavities, occur.

In case reinforcing ribs are formed on the internal side of the vehicle wheel, it is desirable, for the purpose of shortening the casting cycle time, to cool also the upper mold which forms the internal side of the vehicle wheel. However, if the molten material on the internal side is solidified more quickly than that on the external side, unsolidified molten material on the external side is pulled towards the internal side, thereby giving rise to shrinkage cavities on the external side. Therefore, no positive cooling of the upper mold is carried out in the present state of the art.

OBJECT AND SUMMARY OF THE INVENTION

Considering the above point, this invention has an object of providing a method of casting a vehicle wheel in which the casting cycle time can be shortened by positively cooling the mold that forms the internal side of the vehicle wheel and in which no defects, such as, shrinkage cavities, occur by giving different cooling capacities to the mold that forms the internal side and the mold that forms the external side, respectively, of the vehicle wheel.

In order to achieve the above-described object, this invention is a method of casting a vehicle wheel by using mold means, the mold means comprising a lower mold and an upper mold which together form a cavity for molding therein a disk portion of the vehicle wheel, and split molds which form a cavity for molding therein a rim portion of the vehicle wheel by enclosing the lower and the upper molds, the method comprising water-cooling, out of the lower and the upper molds, one mold that forms that external side of the vehicle wheel which faces an outside of a vehicle when mounted thereon, and forcibly air-cooling rib-forming portions which are provided on the other mold that forms an internal side of the vehicle wheel to form ribs on the internal side of the vehicle wheel, the air-cooling being carried out by means of air which flows through air-cooling passages disposed along the rib-forming portions.

By forcibly air-cooling the rib-forming portions provided on the other mold that forms the internal side of the vehicle wheel, the solidifying time of the ribs is shortened. However, since the one mold that forms the external side of the vehicle wheel is water-cooled, the one mold is cooled more quickly than the other mold to be air-cooled. As a consequence, the molten material is solidified from the external side of the vehicle wheel and there occur no defects such as shrinkage cavities on the external side thereof.

Once the molten material in the cavity for forming therein the rim portion becomes solidified, there occurs a clearance, due to contraction by solidification, between the rim portion and the split molds. This clearance functions as a thermally insulating layer to hinder the heat radiation from the rim portion to the split molds. This causes a retarded solidification of the rim portion, a longer casting cycle time and an easier occurrence of mold cavities in the rim portion.

Therefore, according to another feature of this invention, the split molds are opened at the time when a surface layer portion of the molten material in the cavity for the rim portion is solidified, whereby the rim portion is cooled by an atmosphere, and then the lower and the upper molds are opened.

According to this feature, the rim portion is exposed to the atmosphere by opening the split molds and, consequently, the solidification of the rim portion is accelerated.

In this case, it is preferable to judge the degree of solidification of the molten material in the cavity for the rim portion, by detecting the temperature of the split molds, so that the split molds are opened at the time when the temperature of the split molds is down to a predetermined temperature.

BRIEF DESCRIPTION OF THE DRAWINGS

The above and other objects and the attendant advantages of this invention will become readily apparent by reference to the following detailed description when considered in conjunction with the accompanying drawings wherein.

PREFERRED EMBODIMENT OF THE INVENTION

Figure 1:
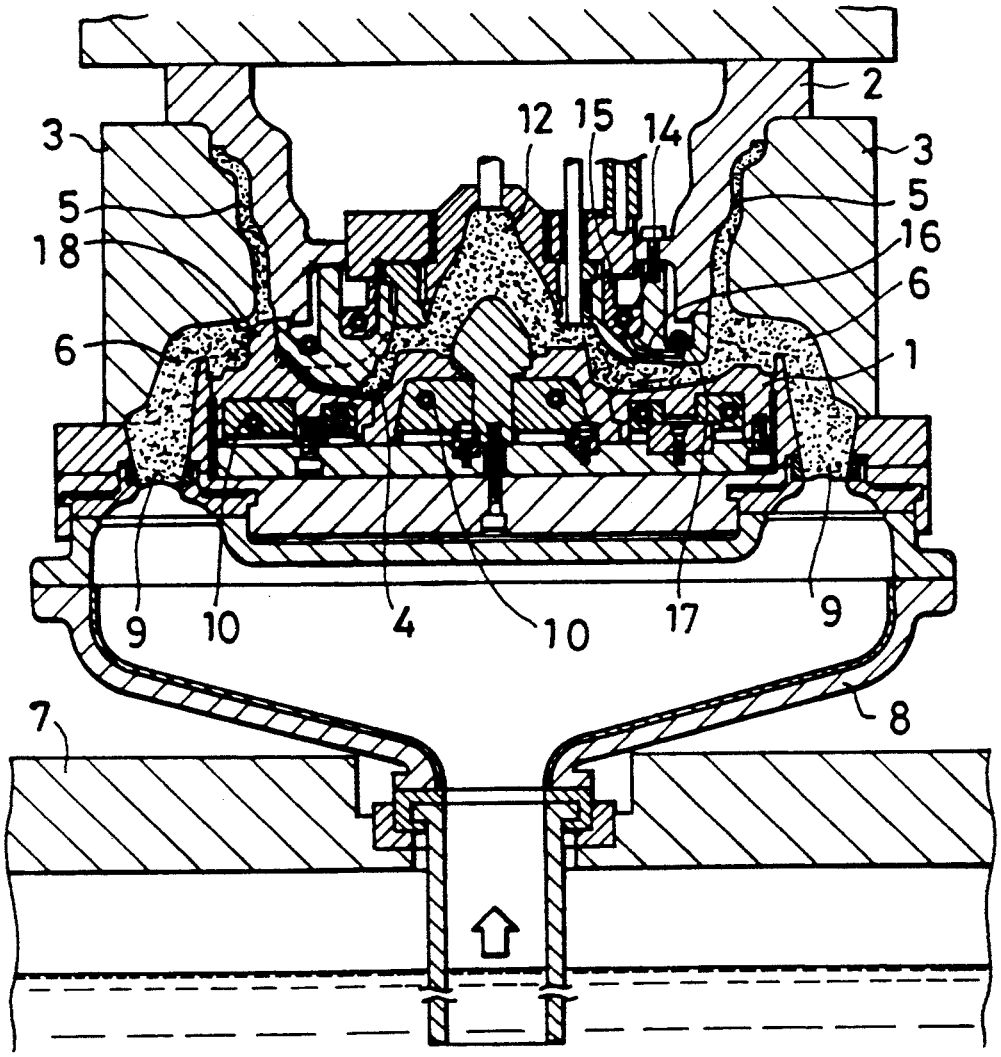
FIG. 1 is a vertical sectional view of mold means to be used in this invention method.

FIG. 1 shows metallic mold means for casting a vehicle wheel. The metallic mold means is made up of a lower mold 1, an upper mold 2, which is movable up and down, and a plurality of split molds 3, which are horizontally slidable, to enclose the lower and the upper molds 1, 2. By mold clamping, through the lowering of the upper mold 2, a cavity 4 for molding a disk portion of the vehicle wheel is formed between the upper mold 2 and the lower mold 1. By mold clamping, through the lateral inward sliding movement of the split molds 3, another cavity 5, for molding a rim portion of the vehicle wheel, is formed between the upper and the lower molds 1, 2 and the split molds 3.

In the split molds 3 there are provided pouring gates 6 which are in communication with the cavity 5 for the rim portion. Molten aluminum, which is held in a molten material holding furnace 7 provided under the lower mold 1, is fed to the pouring gates 6, through a molten material feeding pipe 8 and runners 9 formed in the lower mold 1, by means of a pneumatic pressure to be applied to the furnace 7. The molten aluminum is fed to the cavities 4, 5 from the pouring gates 6 to thereby cast the vehicle wheel by low pressure die casting.

In this embodiment, the lower mold 1 molds that external side of the vehicle wheel which faces the outside of the vehicle when the wheel is actually mounted thereon. The lower mold 1 has buried therein chillers 11, having cast therein cooling water pipes 10, so that the lower mold 1 is water-cooled by the water to flow from an external water supply source (not illustated) through the cooling water pipes 10.

Figure 2:
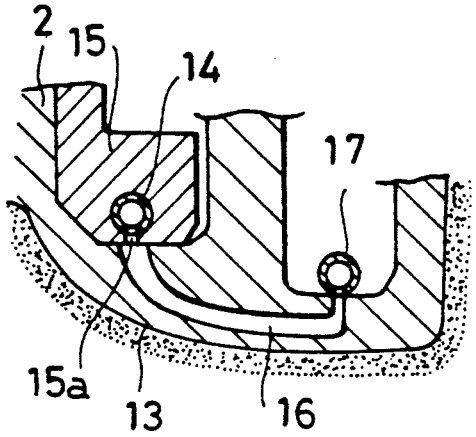
FIG. 2 is an enlarged sectional view of an important portion thereof.

The upper mold 2, for forming the internal side of the vehicle wheel, has formed thereon a riser portion 12 and radial rib-forming portions 13 which form ribs on the internal side of the vehicle wheel. In the upper mold 2 there is further buried therein a chiller 15, having cast therein a circular air-cooling pipe 14, which is in communication with a compressed air supply source (not illustrated). As shown in FIG. 2, radial air passages 16 are formed along each of the rib-forming portions 13. The inner ends of the air passages 16 are connected to the air-cooling pipe 14, via connecting holes 15*a* which are formed in the chiller 15. The outer ends of the air passages 16 are connected to a circular exhaust pipe 17 which is fixed to the upper mold 2 and is in communication with the atmosphere.

According to this arrangement, the upper mold 2 is air-cooled over the entire portion thereof via the chiller 15 by the cooling air to flow through the cooling air pipe 14. At the same time, the rib-forming portions 13 are effectively cooled by the air to flow from the cooling air pipe 14 to the exhaust pipe 17 through the air passages 16, thereby shortening the time of solidifying the molten material at the rib portions. However, the cooling capacity of air cooling is inferior to those of water cooling. Therefore, the molten material inside the cavity 4 is solidified from the side of the lower mold 1, namely, from the external side of the vehicle wheel and, as a result, there will occur no defects such as shrinkage cavities on the external side thereof. When the internal side of the vehicle wheel is solidified, the rib portions are also solidified not so much later than the other portion of the internal surface. As a consequence, the casting cycle time can be shortened.

In the drawings, numeral 18 denotes projections provided in a projecting manner on the lower mold 1 in order to form openings such as wind openings in the periphery of the disk portion of the vehicle wheel.

Figure 3:
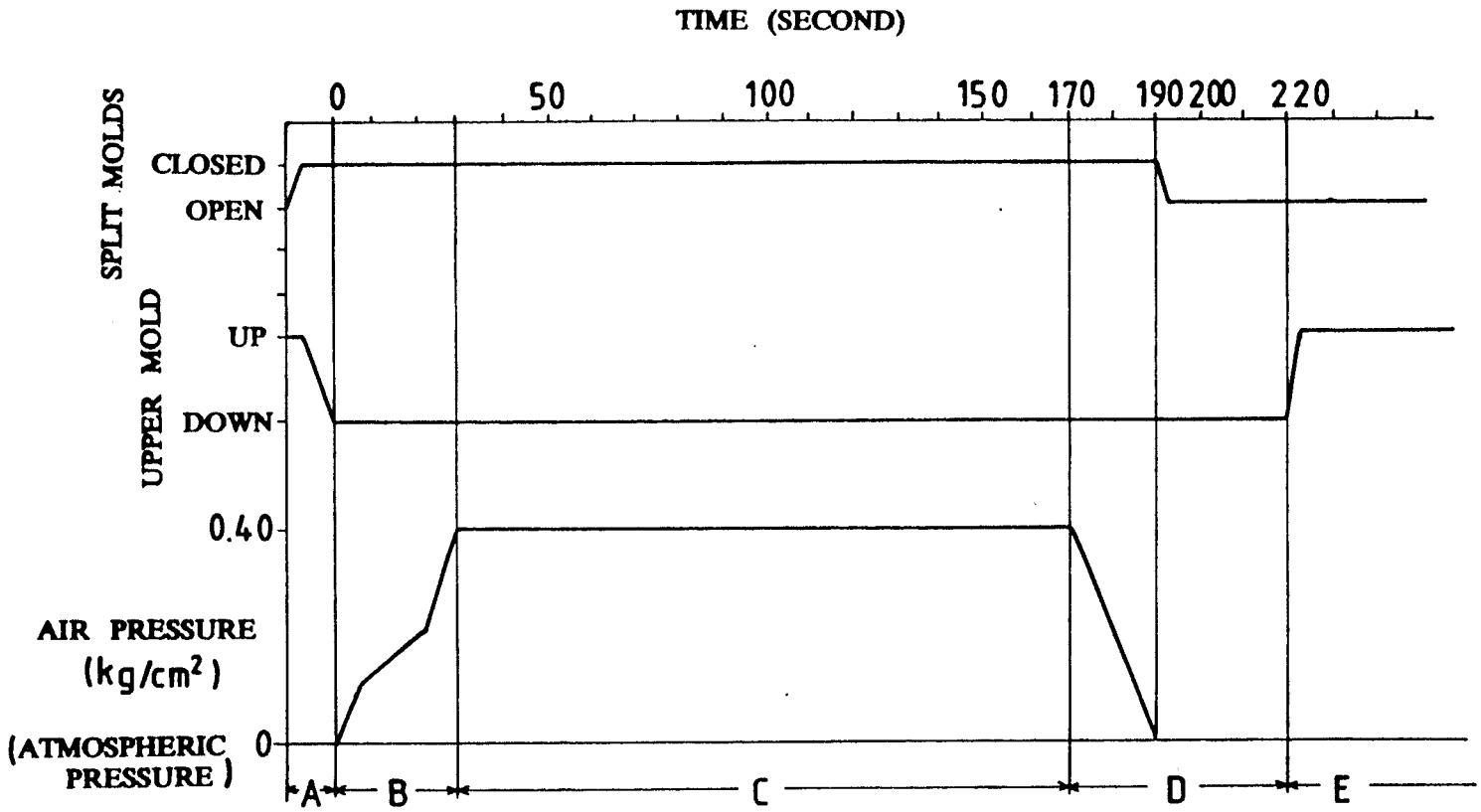
FIG. 3 is a time chart showing one example of the casting step according to this invention method.

The casting step of the vehicle wheel is as shown in FIG. 3. The casting step comprises: step A for mold-clamping the split molds 3 and the upper mold 1; step B for charging the molten material into the cavities 4, 5 by applying air pressure to the inside of the molten material holding furnace 7; step C for pressurizing and holding the molten material inside the cavities by the air pressure; step D for cooling while relieving the pressure; and step E for opening the molds. It is normal practice to open the split molds 3 and the upper mold 1 after the cooling step D. However, in this embodiment, it is so arranged that the split molds 3 are opened in the cooling step D after having exhausted the air pressure, and that the upper mold 2 is opened after the cooling step.

If the cooling step is carried out with the split molds 3 clamped together, there will occur a clearance between the molten material and the split molds 3 as a result of contraction through solidification of the molten material, whereby heat radiation to the split molds 3 is impeded and consequently the solidification of the molten material is delayed. On the other hand, if the split molds 3 are opened, the rim portion is exposed to the atmosphere to thereby accelerate the solidification of the molten material. The time between the start of pouring the molten material to the completion of the pressurizing step was set to be 170 seconds and, after 20 seconds of waiting time which is required for relieving the air pressure, the split molds 3 were opened. Then, the temperature of the rim portion lowered to 384° C. 50 seconds after the completion of the pressurizing step. On the other hand, the temperature of the rim portion remained at 393° C. even 60 seconds after the completion of the pressurizing step if the split molds 3 were kept clamped together.

In case the pouring gates 6 are formed in the split molds 3, if the runners 9 in the lower mold 1 are exposed to the atmosphere by opening the split molds 3 and if the split molds 3 are opened earlier as described above, the molten material staying in the lower part of the runners 9 can surely be dropped in temperature by the air that comes therein through the clearance in the runners 9. Therefore, there occurs no such disadvantage in that the lower ends of runner-scraps to be formed by solidification inside the runners 9 grow larger through solidification of the molten material which remains adhered thereto, and consequently that the grown lower ends of the runner-scraps get caught at the runners 9 at the time of releasing the molds, with consequent damages to the product by the tearing off at the pouring gate portion.

Figure 4:
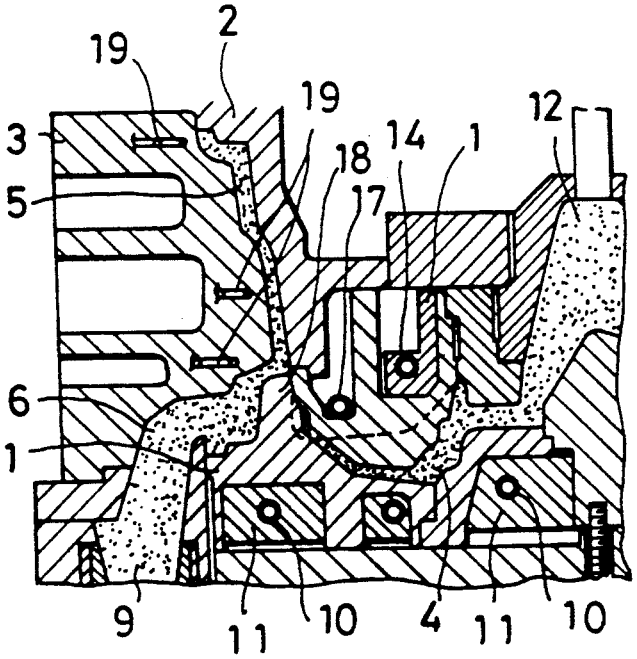
FIG. 4 is a vertical sectional view of split molds showing a modified embodiment of the mold means.

The molten material in the cavity 5 for the rim portion is not thrown out of shape even if the split molds 3 are opened because the surface layer portion of the molten material is solidified in the pressurizing step C. However, in order to surely prevent it from being thrown out of shape, it is advisable to set in place temperature sensors 19, such as, thermocouples, inside the split molds 3, as shown in FIG. 4, to detect the temperature thereof so that the split molds 3 can be opened at the time when the mold temperature has become lower than a predetermined temperature. In this embodiment, in order to detect the temperatures of an upper portion and of an intermediate portion of the cavity 5, as well as the temperature of the runners 9, temperature sensors 19 were disposed in three upper and lower vertical stages. It was then so arranged that the split molds 3 were opened when the temperatures at the upper and intermediate portions as well as the temperature of the runners, reached 420° C., 430° C. and 440° C. or lower, respectively.

It is readily apparent that the above-described method has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of casting a vehicle wheel by using mold means, said mold means comprising a lower mold and an upper mold which together form a cavity for molding therein a disk portion of the vehicle wheel, and split molds which form a cavity for molding therein a rim portion of the vehicle wheel by enclosing the lower and upper molds, said method comprising water-cooling, out of the lower and the upper molds, one mold that forms that external side of the vehicle wheel which faces an outside of a vehicle when mounted thereon, and forcibly air-cooling rib-forming portions which are provided on the other mold that forms an internal side of the vehicle wheel to form ribs on the internal side of the vehicle wheel, said air-cooling being carried out by means of air flowing through air-cooling passages formed in said other mold, said air-cooling passages including at least one passage which extends along the length of the rib-forming portions, the air-cooling passages being inside said other mold and free from communication with said cavities.

2. A method of casting according to claim 4, further comprising opening said split molds at a time when a surface layer portion of the molten material in the cavity for the rim portion is solidified, whereby the rim portion is cooled by an atmosphere, and then opening the lower and the upper molds.

3. A method of casting according to claim 2, further comprising determining a time of opening the split molds by detecting temperature of the split molds.

4. A method of casting according to claim 1, wherein said at least one passage includes radial air passages formed along each of the rib-forming portions.

5. A method of casting according to claim 4, wherein said air-cooling passages include an annular supply pipe connected to first ends of the radial air passages and an annular exhaust pipe connected to opposite ends of the radial air passages.

* * * * *

UNITED STATES PATENT AND TRADEMARK OFFICE

CERTIFICATE OF CORRECTION

PATENT NO. : 5,314,001

DATED : May 24, 1994

INVENTOR(S) : Hidaka et al

It is certified that error appears in the above-indentified patent and that said Letters Patent is hereby corrected as shown below:

Cover page, Item [73], "Honda Giken Kabushiki Kaisha" should read --Honda Giken Kogyo Kabushiki Kaisha--.

Column 6, Claim 2, line 1, change "claim 4" to --claim 1--.

Signed and Sealed this

Twenty-ninth Day of November, 1994

*Attest:*

Bruce Lehman

BRUCE LEHMAN

*Attesting Officer*

*Commissioner of Patents and Trademarks*